United States Patent [19]

Gremminger

[11] Patent Number: 4,584,736

[45] Date of Patent: Apr. 29, 1986

[54] SURFACE CLEANING APPARATUS

[76] Inventor: Gottfried Gremminger, Sonnenstrasse 5, 9243 Jonschwil, Switzerland

[21] Appl. No.: 573,863

[22] Filed: Jan. 25, 1984

[30] Foreign Application Priority Data

Jan. 26, 1983 [CH] Switzerland ..... 422/83

[51] Int. Cl.[4] ..... A47L 11/30

[52] U.S. Cl. ..... 15/322; 15/402

[58] Field of Search ..... 15/320, 321, 322

[56] References Cited

U.S. PATENT DOCUMENTS

| | | | |
|---|---|---|---|
| 3,538,535 | 11/1970 | Ginsbourgh et al. | 15/322 X |
| 3,747,155 | 7/1973 | Koellisch | 15/321 X |
| 3,840,935 | 10/1974 | Fitzgerald et al. | 15/322 |
| 3,896,521 | 7/1975 | Parise | 15/322 X |
| 4,161,802 | 7/1979 | Knight et al. | 15/322 X |
| 4,168,562 | 9/1979 | Maasberg | 15/322 X |
| 4,182,001 | 1/1980 | Krause | 15/320 |
| 4,194,262 | 3/1980 | Finley et al. | 15/321 X |
| 4,272,861 | 6/1981 | Notta et al. | 15/322 X |
| 4,441,229 | 4/1984 | Monson | 15/322 |

*Primary Examiner*—Chris K. Moore

*Attorney, Agent, or Firm*—Peter K. Kontler; Tobias Lewenstein

[57] ABSTRACT

An apparatus for cleaning surfaces has a cleaning head which is designed to bear against a surface being cleaned. The cleaning head includes a discharge nozzle which is connected with a source of flowable cleaning material and is arranged to discharge such material against the surface being cleaned. A pair of shields is disposed about the discharge nozzle. The cleaning head further includes a suction nozzle which is connected with a source of suction and serves to remove contaminated cleaning material from the surface being cleaned. A brush is disposed between the discharge nozzle and the suction nozzle and functions to scrub the surface after the cleaning material has been applied thereto. The discharge nozzle, suction nozzle and brush are surrounded by a tubular sleeve which inhibits the escape of contaminated cleaning material so that virtually all such material is recovered via the suction nozzle.

19 Claims, 3 Drawing Figures

SURFACE CLEANING APPARATUS

BACKGROUND OF THE INVENTION

The invention relates generally to the cleaning of surfaces.

More particularly, the invention relates to an apparatus for cleaning surfaces.

A known surface cleaning apparatus has a discharge nozzle which is directed towards the surface to be cleaned. The discharge nozzle is connected with a supply line through which a flowable cleaning material is conveyed to the discharge nozzle under pressure. The cleaning material leaves the supply line via the discharge nozzle and impinges upon the surface being cleaned. A suction nozzle is provided to suction used cleaning material from the surface being cleaned. The suction nozzle is connected with a suction line which conveys the used cleaning material to a suitable location for disposal.

The known surface cleaning apparatus of this type are intended mainly for cleaning carpets and floors. Such apparatus cannot be used to clean walls, ceilings, glass panes, facades and so on. The reason is that the cleaning material runs down and escapes before it can be sucked up by the suction nozzle.

OBJECTS AND SUMMARY OF THE INVENTION

It is an object of the invention to provide a surface cleaning apparatus which enables the loss of used cleaning material to be reduced.

Another object of the invention is to provide a surface cleaning apparatus which is well-suited for cleaning not only horizontal surfaces but vertical surfaces as well.

An additional object of the invention is to provide a surface cleaning apparatus which is capable of cleaning virtually any type of surface.

It is also an object of the invention to provide a surface cleaning apparatus which is capable of removing used cleaning materials from a surface being cleaned with a high degree of efficiency.

A further object of the invention is to provide a surface cleaning apparatus which enables a high degree of safety to be achieved.

Yet another object of the invention is to provide a surface cleaning apparatus which makes it possible to conveniently clean even elevated surfaces.

The preceding objects, as well as others which will become apparent as the description proceeds, are achieved by the invention.

One aspect of the invention resides in a surface cleaning apparatus having a source of flowable cleaning material, and a first device connected with this source and arranged to direct the cleaning material against a surface being cleaned.

A source of suction is provided, and a second device is connected with the suction source and is arranged to suction used cleaning material from the surface being cleaned. An enclosure surrounds both the first device and the second device. The enclosure has an end which is arranged to confront the surface being cleaned, and this end is provided with an opening arranged to expose the first and second devices to the surface being cleaned.

The first device which directs the cleaning material against the surface may be in the form of a discharge or blasting nozzle while the second device which removes the cleaning material from the surface may be in the form of a suction nozzle.

The source of cleaning material may include a supply of cleaning material under pressure, and a pressure line or pipe for conveying the pressurized cleaning material to the discharge nozzle. The suction source may include a suction line or pipe which conveys the used cleaning material to a suitable location for disposal or recycling.

Preferably, the end of the enclosure which confronts the surface being cleaned is entirely open. Advantageously, the opposite end of the enclosure is also at least partly open. According to one embodiment of the invention, the enclosure is in the form of a tubular section.

It is further preferred that end of the enclosure which confronts the surface being cleaned be resilient.

The surface cleaning apparatus of the invention is capable of operating with very little escape of cleaning material, and may operate virtually dry when a liquid cleaning material is used. This is due to the enclosure which confines the cleaning material so that it may be sucked up.

The novel features which are considered as characteristic of the invention are set forth in particular in the appended claims. The improved surface cleaning apparatus itself, however, both as to its construction and its mode of operation, together with additional features and advantages thereof, will be best understood upon perusal of the following detailed description of certain specific embodiments with reference to the accompanying drawings.

DESCRIPTION OF THE PREFERRED EMBODIMENTS

Figure 1:
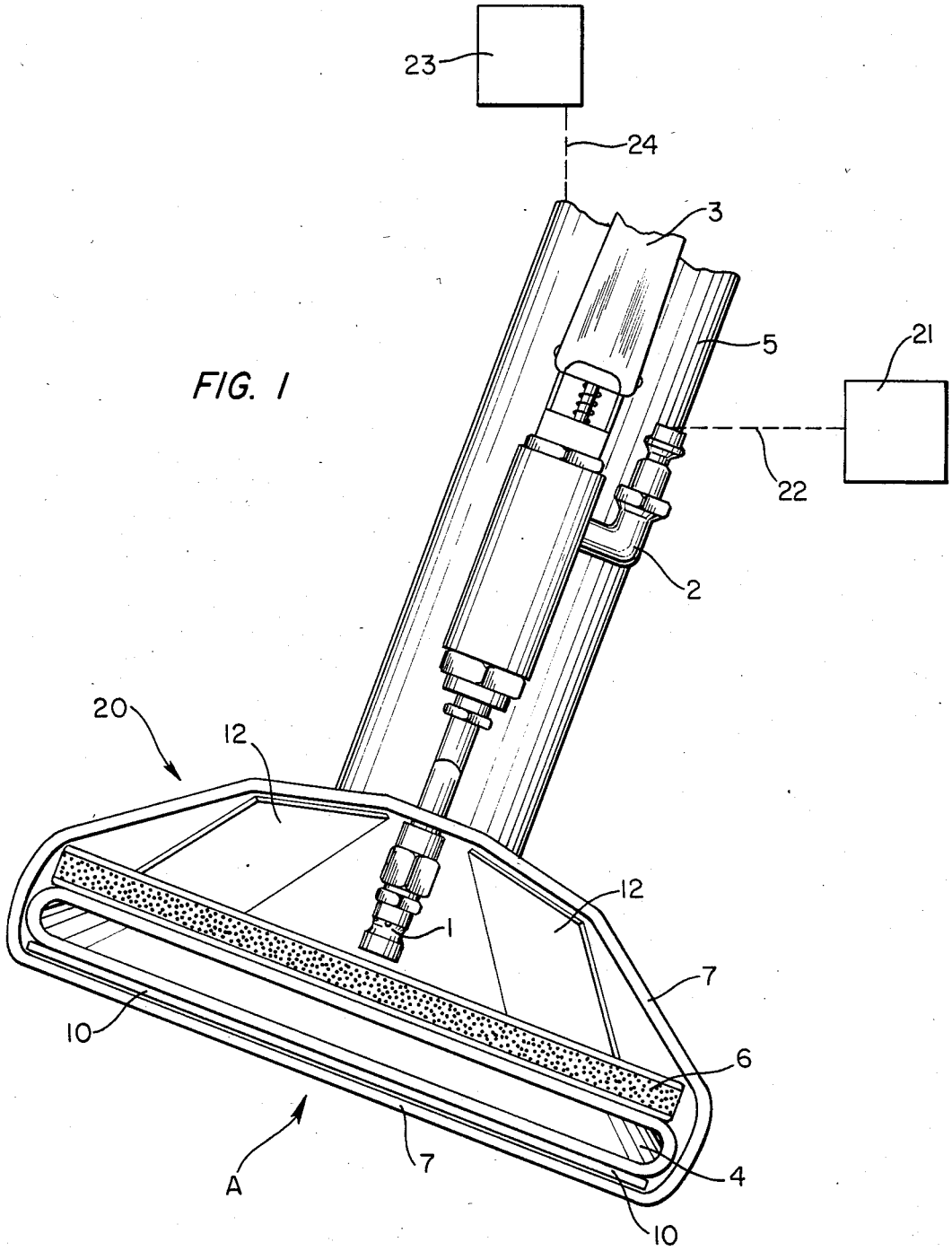
FIG. 1 is a bottom plan view of the portion of the surface cleaning apparatus via which cleaning material is directed against and removed from the surface being cleaned.
Figure 2:
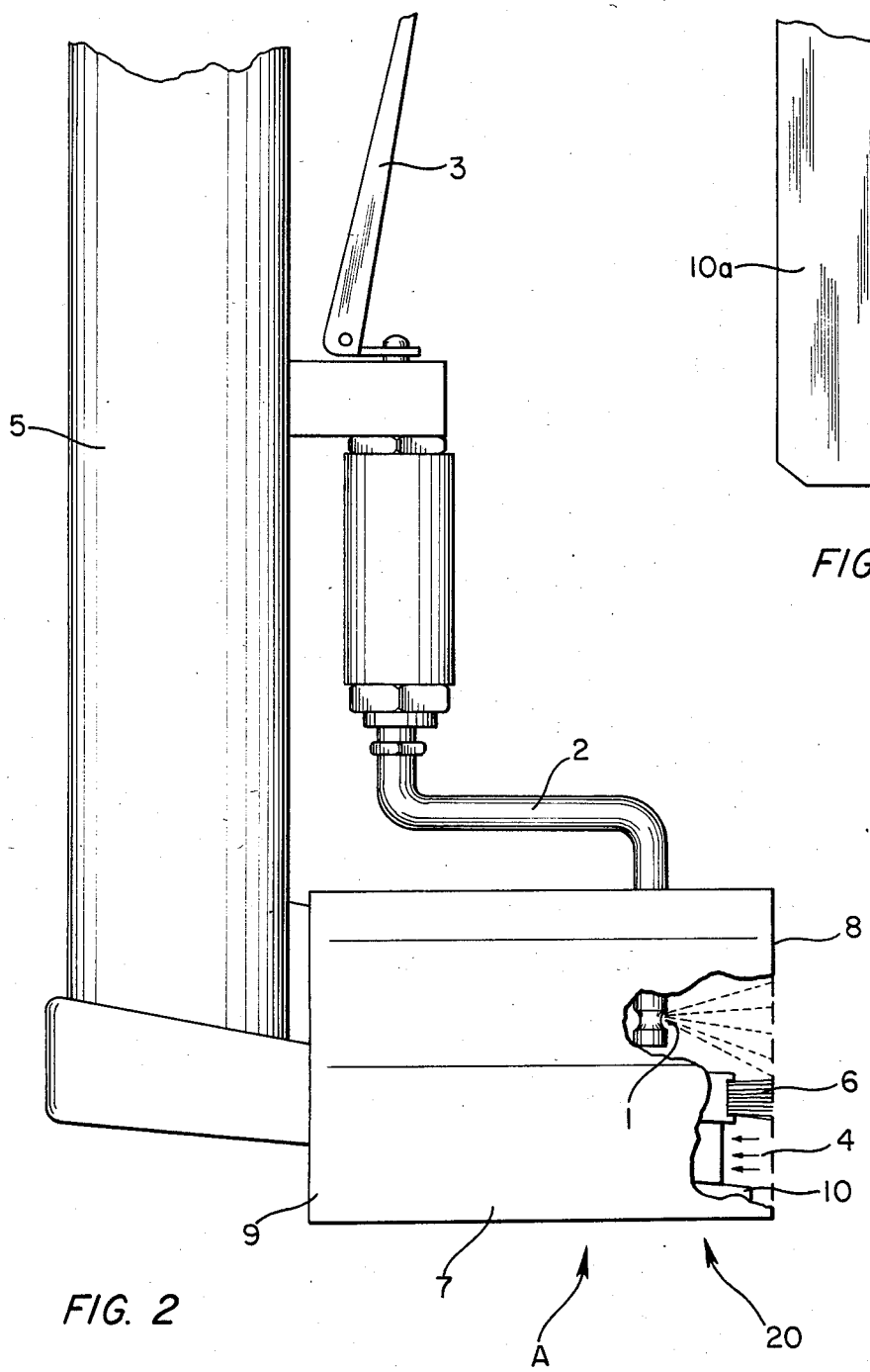
FIG. 2 is a partly broken away side view of the portion of the surface cleaning apparatus illustrated in FIG. 1.

The surface cleaning apparatus of the invention illustrated in FIGS. 1 and 2 includes a cleaning head 20 which, during operation, is located adjacent to the surface being cleaned. The cleaning head 20 includes a device 1 in the form of a discharge or blasting nozzle for directing a flowable cleaning material against the surface being cleaned. The discharge nozzle 1 is connected with a pressure line or pipe 2 which, as schematically illustrated by the broken line 22, leads to a supply unit 21. The supply unit 21 admits a flowable cleaning material into the line 2 under pressure, e.g. at a pressure of four atmospheres above atmospheric pressure. The supply unit 21 may, for example, include a pump for forwarding the cleaning material to the line 2. While any appropriate cleaning material may be used, a liquid cleaning material is currently preferred.

A lever 3 is provided to control the discharge of cleaning material onto the surface being cleaned. The lever 3 is movable between an open position in which the cleaning material is free to flow through the discharge nozzle 1 onto the surface being cleaned, and a closed position in which the cleaning material is prevented from flowing through the discharge nozzle 1. The lever 3, which may be operated by finger pressure, is biased to its closed position by a spring. When the lever 3 is moved away from its closed position against the action of the spring by finger pressure, the cleaning material flows out of the discharge nozzle 1. Upon release of the finger pressure, the lever 3 returns to its closed position under the action of the spring, and the flow of cleaning material through the discharge nozzle 1 is terminated.

The cleaning head 20 further comprises a device 4 in the form of a suction nozzle for suctioning used or contaminated cleaning material from the surface being cleaned. The suction nozzle 4 is elongated and extends normal to the direction A in which the cleaning head 20 is moved during a cleaning operation. Depending upon the particular application of the surface cleaning apparatus, the length of the suction nozzle 4 may vary from about 3 centimeters to about 100 centimeters.

The suction nozzle 4 is connected with a suction line or hose 5 which, in turn, communicates with a vacuum unit 23 via a connection schematically indicated by the dashed line 24. The vacuum unit 23 may comprise a conventional device such as, for instance, a vacuum pump, capable of creating suction. By way of example, the vacuum unit 23 may cause a suction force equivalent to a water column of 2.8 meters or 2,800 millimeters to be developed at the suction nozzle 4.

The pressure line 2 and the suction line 5 may both be flexible.

A brush 6 is mounted between the discharge nozzle 1 and the suction nozzle 4. Similarly to the suction nozzle 4, the brush 6 is elongated transversely to the direction A in which the cleaning head 20 moves during a cleaning operation. The brush 6 is removably mounted on the cleaning head 20. This enables brushes with different types of bristles to be inserted in the cleaning head 20 depending upon the type of cleaning operation to be performed. Preferably, the surface cleaning apparatus is provided with at least five different types of interchangeable brushes. By way of example, brushes with hog's bristles are provided to clean windows while brushes with brass or hard polypropylene bristles are provided to clean facades.

The cleaning head 20 further includes an enclosure 7 which surrounds the discharge nozzle 1, the suction nozzle 4 and the brush 6. The enclosure 7 has an end 8 which confronts the surface being cleaned, that is, the end 8 of the enclosure 7 either contacts or is closely adjacent to the surface being cleaned. In the preferred embodiment illustrated, the end 8 of the enclosure 7 is entirely open so that the discharge nozzle 1, the suction nozzle 4 and the brush 6 are fully exposed to the surface being cleaned. The end 9 of the enclosure 7, which is located opposite the end 8, is advantageously at least partly open.

The enclosure 7 may be in the form of a tubular sleeve or jacket.

The enclosure 7, or at least the end 8 thereof which confronts the surface being cleaned, is composed of a resilient material. Natural rubber constitutes a particularly suitable resilient material for the enclosure 7.

The brush 6 should be arranged so as to contact the surface being cleaned. To this end, the brush 6 is either flush with the end 8 of the enclosure 7 or projects slightly beyond the end 8. FIG. 2 shows the brush 6 and the end 8 to be flush. On the other hand, the discharge nozzle 1 and the suction nozzle 4 should be recessed in the enclosure 7 as also illustrated in FIG. 2. Preferably, the discharge nozzle 1 and the suction nozzle 4 are located at least one centimeter from the end 8 of the enclosure 7.

A semi-rigid or rigid sheet 10 is disposed between the suction nozzle 4 and the enclosure 7. The sheet 10 functions to reinforce the enclosure 7 which is designed so as to have relatively little resistance to deformation. The reinforcement sheet 10 may be composed of a synthetic resin. Neoprene is exemplary of the synthetic resins which may be used for the reinforcing sheet 10.

The enclosure 7 may be further strengthened in the region of the reinforcing sheet 10 by appropriate means such as, for instance, overlapping.

Figure 3:
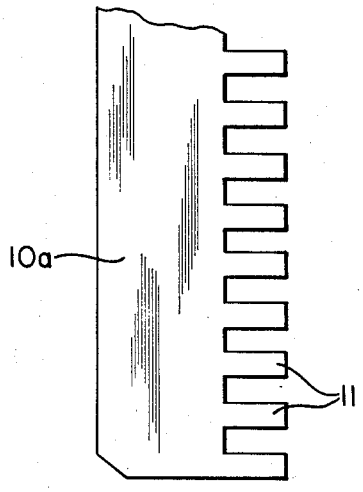
FIG. 3 illustrates a component of the surface cleaning apparatus which increases the effectiveness of the apparatus on grooved surfaces.

FIG. 3 illustrates a reinforcing sheet **10*a* which is particularly well-suited for cleaning grooved surfaces such as the surfaces of escalators. The reinforcing sheet 10*a* has a comb-like configuration and is formed with teeth 11 which project beyond the end 8 of the enclosure 7. During a cleaning operation, the teeth 11 extend into the grooves of the surface being cleaned. Due to the fact that the teeth 11 penetrate into the grooves of the surface being cleaned, an almost air tight seal extending towards the front of the cleaning head 20 is formed between the suction region of the suction nozzle 4** and the surroundings. This increases the suction force in the grooves thereby enhancing the cleaning effect.

Advantageously, the comb-like reinforcing sheet **10*a*, or at least the teeth 11 thereof, is or are composed of an elastic material. The comb-like reinforcing sheet 10*a*** is interchangeable.

As seen in FIG. 1, two panels or plates 12 serving as shields are disposed to the sides of the discharge nozzle 1. The shielding panels 12 are spaced from the discharge nozzle 1 and are inclined relative to one another so as to define a V-shaped shield. Each of the shielding panels 12 has a fixed end portion which is located in the region of the discharge nozzle 1 and a free end portion which is remote from the discharge nozzle 1. The shielding panels 12 are inclined relative to one another in such a manner that the free ends thereof are located at least approximately opposite the ends of the brush 6.

The surface cleaning apparatus of the invention may be designed to be manually transportable. To this end, the supply unit 21 and the vacuum unit 23 may be mounted on a wheeled carriage.

The surface cleaning apparatus may be provided with suitable means, e.g. a magnetic motor, for vibrating the brush 6.

In operation, the cleaning head 20 is positioned so that the end 8 of the enclosure 7 bears against or is located adjacent to the surface to be cleaned. The cleaning head 20 is then displaced along the surface in the direction A while the lever 3 is manipulated so as to cause the discharge nozzle 1 to direct the cleaning material against the surface. The brush 6 scrubs the surface after the cleaning material has been applied thereto. The resulting mixture of cleaning material and dirt is subsequently suctioned from the surface by the suction nozzle 4.

The enclosure 7 inhibits the escape of the contaminated or used cleaning material. As a result, virtually all such cleaning material is recovered via the suction nozzle 4 even when cleaning vertical surfaces or ceilings.

The surface cleaning apparatus of the invention makes it possible to dispense with a scaffold when cleaning the facades of buildings up to ten meters in height. All that is required is a ladder meeting the prescribed safety specifications.

Although the cleaning head 20 is shown as having a single discharge nozzle 1 and a single suction nozzle 4, it will be understood that the cleaning head 20 may be provided with a plurality of discharge nozzles and/or a plurality of suction nozzles.

The supply unit 21 may include a storage container for the cleaning material to be advanced to the discharge nozzle 1. Similarly, the vacuum unit 23 may comprise a receptacle for receiving the contaminated or used cleaning material removed from the surface being cleaned by the suction nozzle 4.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An apparatus for cleaning a grooved surface, said apparatus comprising:

(a) a first source of flowable cleaning material;

(b) a first device connected with said first source and arranged to direct the cleaning material against the surface being cleaned;

(c) a second source of suction;

(d) a second device connected with said second source and arranged to suction used cleaning material from the surface being cleaned;

(e) an enclosure surrounding both said first device and said second device, said enclosure having one end which is arranged to confront the surface being cleaned, and said one end having an opening arranged to expose said first and second devices to the surface being cleaned; and (f) means for stiffening the walls of said enclosure, said stiffening means including teeth designed to be received in the grooves of the surface being cleaned to thereby enhance the suction force of said second device in the grooves.

2. An apparatus for cleaning walls, ceilings and stairs, said apparatus including a handheld unit which comprises:

(a) a discharge nozzle designed to be connected with a first source of pressurized cleaning material and arranged to direct the cleaning material against a surface being cleaned;

(b) a suction nozzle designed to be connected with a second source of suction and arranged to suction used cleaning material from the surface being cleaned;

(c) a stationary brush fixedly mounted between said nozzles and arranged to contact the surface being cleaned; and (d) an enclosure entirely circumscribing said nozzles and said brush, said enclosure having a circumferentially complete, resilient end arranged to engage the surface being cleaned, and said resilient end having an opening arranged to expose said nozzles and said brush to the surface being cleaned.

3. The apparatus of claim 2, wherein said resilient end is entirely open.

4. The apparatus of claim 2, said enclosure having another end opposite said resilient end; and wherein said other end is open.

5. The apparatus of claim 2, wherein said enclosure is tubular.

6. The apparatus of claim 2, wherein said resilient end comprises natural rubber.

7. The apparatus of claim 2, wherein said first source comprises a pressurized supply of the cleaning material, and a pressure line on said unit for conveying the pressurized cleaning material to said discharge nozzle.

8. The apparatus of claim 2, wherein said second source comprises a suction line on said unit for conveying used cleaning material away from said suction nozzle.

9. The apparatus of claim 2, said section nozzle being designed to be displaced along a predetermined direction during cleaning of the surface; and wherein said suction nozzle is provided with an elongated aperture extending transversely of said predetermined direction.

10. The apparatus of claim 2, wherein said brush is removable.

11. The apparatus of claim 10, said brush being designed to be displaced along a predetermined direction during cleaning of the surface; and wherein said brush is elongated transversely of said predetermined direction.

12. The apparatus of claim 2, wherein said unit comprises means for stiffening the walls of said enclosure.

13. The apparatus of claim 12, wherein said stiffening means comprises a stiffening sheet disposed between said suction nozzle and said enclosure.

14. The apparatus of claim 1, wherein said stiffening means has a comb-like configuration.

15. The apparatus of claim 2, wherein said unit comprises shielding means disposed about said discharge nozzle.

16. The apparatus of claim 15, wherein said shielding means comprises a pair of shielding plates disposed at different sides of said discharge nozzle.

17. The apparatus of claim 16, wherein said shielding plates are inclined relative to one another so that said shielding means has an approximately V-shaped configuration.

18. The apparatus of claim 16, said brush having opposite end portions; and wherein each of said shielding plates has a free end remote from said discharge nozzle and facing a respective end portion of said brush.

19. The apparatus of claim 15, wherein said shielding means is spaced from said discharge nozzle.

* * * * *